United States Patent [19]

Hayes, Sr.

[11] Patent Number: 4,952,169

[45] Date of Patent: Aug. 28, 1990

[54] SEALED ELECTRICAL CONNECTOR EMPLOYING INSULATION DISPLACEMENT TERMINALS

[75] Inventor: Earl J. Hayes, Sr., Mechanicsburg, Pa.

[73] Assignee: AMP Incorporated, Harrisburg, Pa.

[21] Appl. No.: 372,067

[22] Filed: Jun. 27, 1989

[51] Int. Cl.[5] ..... H01R 4/24

[52] U.S. Cl. ..... 439/403; 439/402; 439/620

[58] Field of Search ..... 439/392–408, 439/417–419, 620, 621

[56] References Cited

U.S. PATENT DOCUMENTS

| | | | |
|---|---|---|---|
| 4,113,341 | 9/1978 | Hughes | 439/620 |
| 4,272,147 | 6/1981 | Berglund et al. | 439/403 |
| 4,413,871 | 11/1983 | Swengel, Jr. | 439/620 |
| 4,428,633 | 1/1984 | Lundergan et al. | 439/620 |
| 4,547,034 | 10/1985 | Forberg et al. | 439/406 |
| 4,822,299 | 4/1989 | Rider, Jr. | 439/402 |

FOREIGN PATENT DOCUMENTS

| | | | |
|---|---|---|---|
| 1026206 | 6/1983 | U.S.S.R. | 439/408 |

*Primary Examiner*—David L. Pirlot
*Attorney, Agent, or Firm*—Robert W. Pitts

[57] ABSTRACT

A sealed, filtered connector for establishing a disconnectable termination to two wires with a capacitor extending between the two terminals is disclosed. Each terminal has a first slotted or insulation displacement contact section facing outwardly with an intermediate slotted plate contact located between the first outwardly facing contact section and a pin receptacle located at the opposite end of the terminal. The terminals are positioned within a insulative housing having passages for receiving the pin receptacle portions and a cavity located at an opposite end. Sealant can be deposited within the cavity. The electrical termination with leads on a capacitor located within the housing is laterally offset from the insulation displacement contact with the wires and the pin receptacle is laterally offset from each slotted plate interconnection.

9 Claims, 4 Drawing Sheets

12
22
20
44
44
21
24
23
36
34
10
30
31
38
16

12
22
23
44
44
34
14
10
38
16
18

Fig. 6
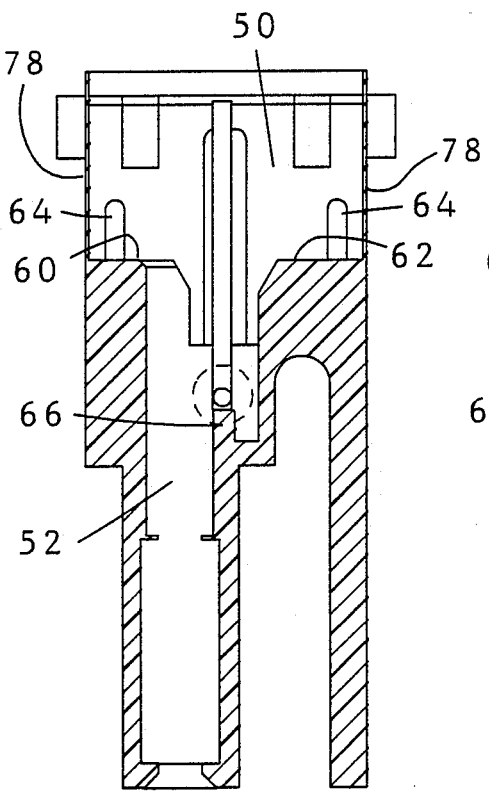
Fig. 7
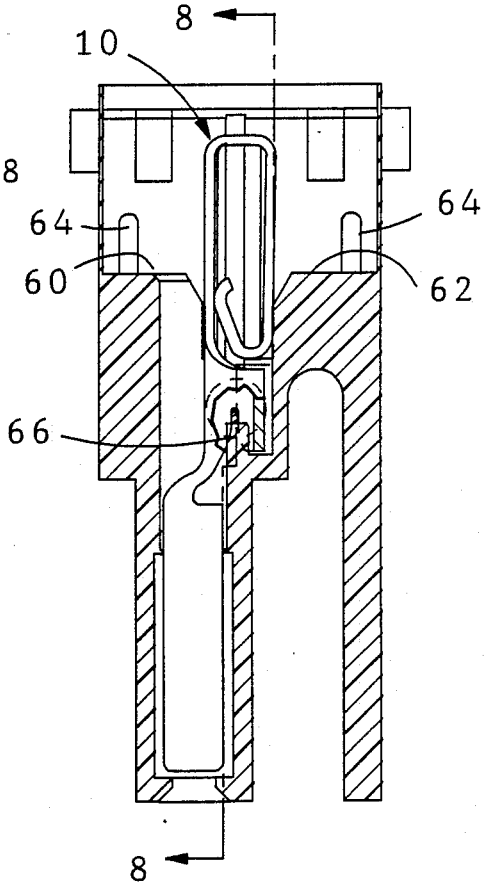
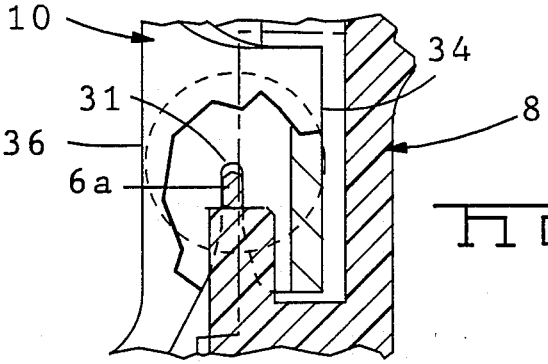
Fig. 7A

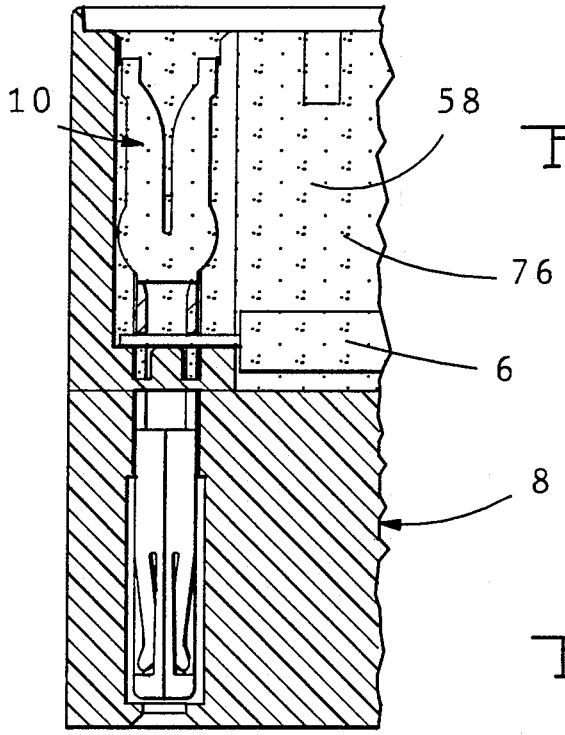
Fig. 9
Fig. 10
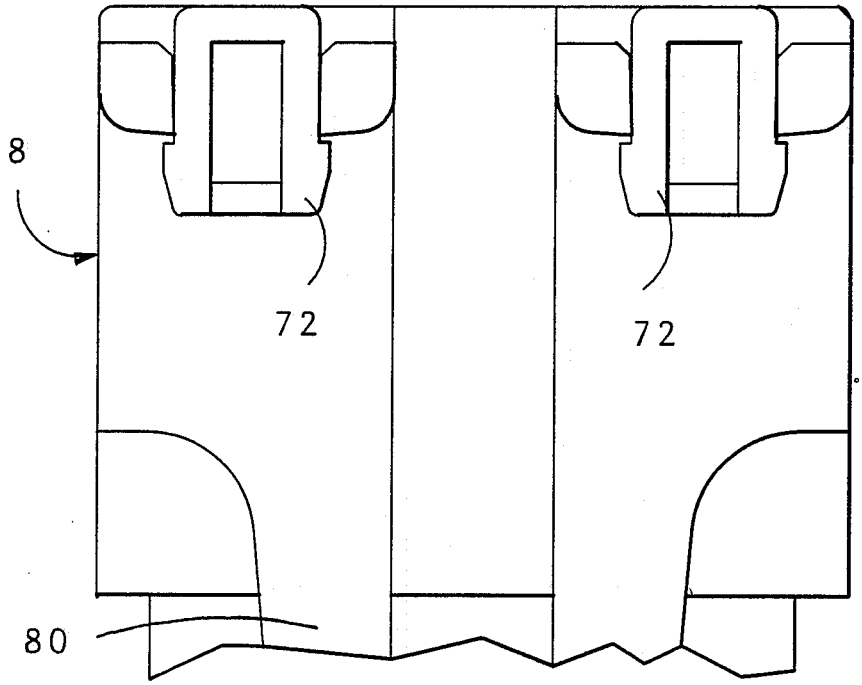

SEALED ELECTRICAL CONNECTOR EMPLOYING INSULATION DISPLACEMENT TERMINALS

BACKGROUND OF THE INVENTION

1. Field of the Invention

This invention relates to an electrical connector and more particularly relates to an electrical connector having insulation displacement or slotted plate contacts for making an interconnection between a wire and another member and more particularly relates to an insulation displacement terminal and connector which can be used not only to terminate wires but also to interconnect an electrical component such as a capacitor to those wires.

2. Description of the Prior Art

Insulation displacement or slotted plate techniques have been employed to make an interconnection with an auxiliary component positioned within a connector housing. U.S. Pat. No. 4,113,341 discloses a connector used to establish an insulation displacement connection to a diode. The terminal employed in that connector establishes a crimped interconnection between two wires and a diode is positioned between those two wires by means of insulation displacement or slotted plate contacts. U.S. Pat. No. 4,413,871 discloses a tap connector having through contact terminals suitable for terminating a wire in a wire receiving slot. A second tap connector terminal is positioned in a recess which is spaced from the first terminal and a leaded capacitor can be terminated by the slotted plate terminals. U.S. Pat. No. 4,428,633 discloses a means for establishing an insulation displacement contact with a capacitor in a dual in-line socket assembly.

Insulation displacement techniques have also been used for sealed connectors. U.S. Pat. No. 4,645,285 discloses a sealed insulation displacement connector comprising a first housing member in which an electrical terminal having a slotted insulation displacement section is located. A second housing member in which a elastomeric body of sufficient rigidity is disposed so that when an insulated conductor is aligned with a slotted insulation displacement section, the housing members can be moved relative to each other causing the elastomeric body to forcefully move the insulated conductor into the slotted insulation displacement section to terminate the conductor. The elastomeric body sealingly engages the connection formed between the conductor and the electrical terminal.

Insulation displacement terminals have also been employed to terminate wires in slots facing in opposite directions. U.S. Pat. No. 4,118,103 discloses a double ended electrical connecting device for connecting two wires to each other. This terminal is generally "U" shaped and comprises a web and side walls. Side walls are reversely bent inwardly towards each other and towards the web so that a double thickness of metal is provided in the upper portions of the sidewalls which are remote from the web. The wire receiving opening is provided in the web and this opening merges with wire receiving slots extending partially along the side walls. Additional wire receiving slots extend inwardly from the upper edges of the side walls through portions of the double thickness of metal. One wire is moved laterally of its axis into each of the slots electrically to connect both wires to a connecting device and to each other.

The slots are different sizes to terminate wires of different gauges.

Typically, a insulation displacement connector or terminal is configured such that the wires move laterally of its axis into a terminal position within a housing. However, some electrical connectors employ a configuration in which the wire is positioned in the housing and the terminal is moved further into the housing to engage the wire. U.S. Pat. No. 4,232,927 discloses an electrical connector of this type.

SUMMARY OF THE INVENTION

An electrical connector and an insulation displacement or slotted plate electrical connector used therein comprise the invention claimed herein. The electrical terminal is used to establish an insulation displacement electrical connection to two wires and to establish a disconnectable electrical connection between both wires and a mating terminal. In the preferred embodiment of this invention, one of the wires in question comprises a lead of an electrical component such as a capacitor positioned within the electrical connector housing. The electrical terminal is stamped and formed and has a first slotted plate contact with the slot facing in the first direction. A second slotted plate contact located intermediate at the ends of the terminal has a slot facing in an opposite direction. A contact section suitable for forming a disconnectable contact with a mating terminal is positioned on the end of the terminal opposite from the first slotted plate contact. A wire moved laterally of its axis into the first slotted plate contact can be terminated to another wire or lead in which the electrical termination is made by shifting the terminal in a direction relative to the stationery wire. In the preferred embodiment of this invention the second slotted plate contact is laterally offset from the plane containing the first slotted plate contact and the disconnectable contact section is offset in an opposite direction. Also in the preferred embodiment of this invention the second slotted plate contact is located in a plane extending transversely relative to a plane containing the first slotted plate contact.

The electrical connector in which these terminals can be employed comprises an insulative housing having passages into which the terminals extend. The first insulation displacement or slotted plate contact means will be positioned adjacent the first side of the housing and the disconnectable contact section will be positioned on an opposite second side of the housing. The housing includes wire supporting surfaces for both the first insulation displacement contact and the second insulation displacement contact. The housing includes a cavity on the first side with a pocket communicating with the cavity for receiving the discrete electrical component such as a capacitor. A sealant may be disposed within the cavity and the pocket to seal each electrical termination and seal the discrete component located within the housing.

BRIEF DESCRIPTION OF THE DRAWINGS

FIG. 6 is a section view showing the interior of the housing cavity and passages and showing the position in which a capacitor would be disposed.

FIG. 7 is a section view similar to section in FIG. 6 showing a terminal disposed in housing and FIG. 7A is an enlarged view of the insulation displacement termination of capacitor leads.

FIG. 8 is a section view substantially along sections lines 8—8 in FIG. 8, but also showing wires and a cover exploded from the connector housing. FIG. 8 also shows a terminal in one of two passages in the housing and shows an empty passage.

FIG. 9 is a section view of the housing showing sealant disposed within the upper cavity.

FIG. 10 is a side view of the housing showing the cover attached to the housing.

FIG. 11 is a top view of the cover.

FIG. 12 is a end view of the cover.

FIG. 13 is a side view of the cover showing the latches.

FIG. 14 shows the bottom of the cover so that the interior of the cover exposed.

DETAILED DESCRIPTION OF THE PREFERRED EMBODIMENT

Figure 1A:
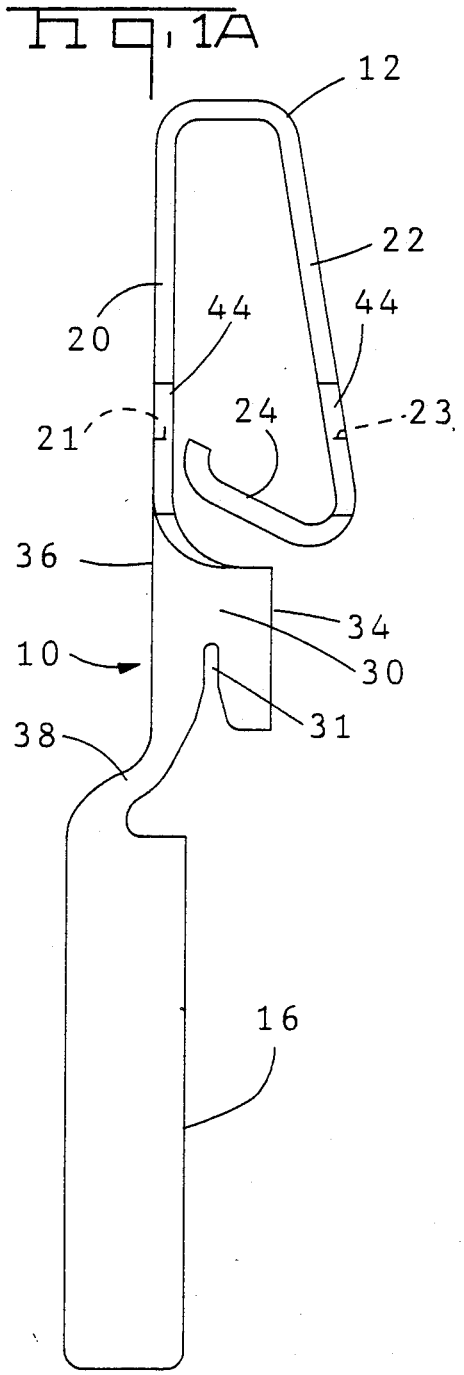
FIGS. 1A and 1B are front and side views of an insulation displacement terminal comprising the preferred embodiment of this invention.

The various components of the electrical connector 2 are best shown in the partial section shown in FIG. 8. The electrical connector 2 is intended for terminating wires 4 and a capacitor 6 to terminals 10 located within an insulative housing 8. Terminal 10 can be fabricated of a conventional electrical conductive metal while the insulative housing 8 can be fabricated from a conventional insulative material such as those used with other conventional electrical connectors.

Figure 1B:
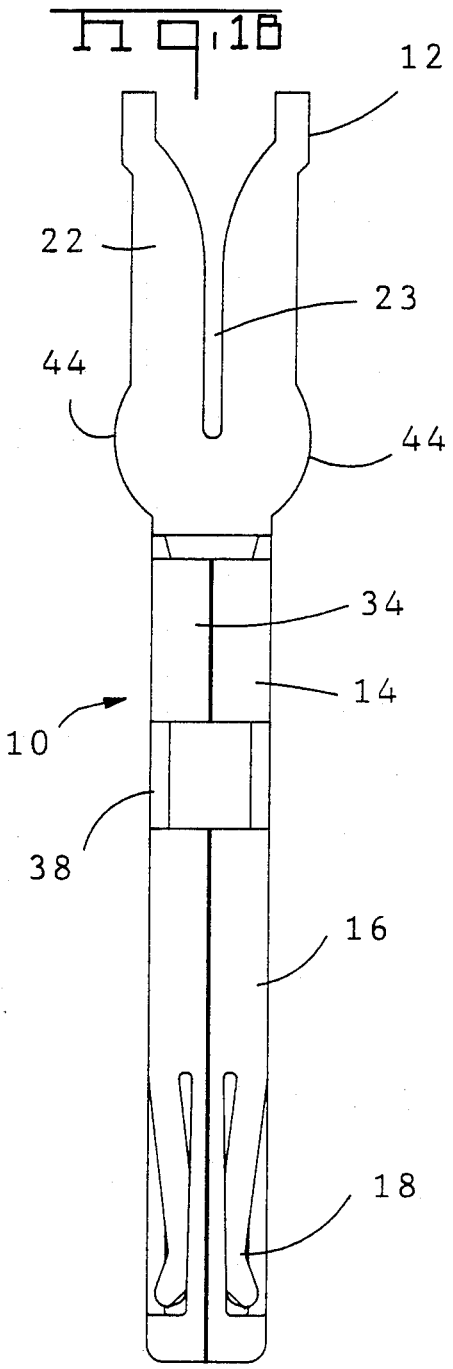

The electrical terminal 10 shown in FIGS. 1A and 1B has a first slotted plate contact section 12 adjacent one end. A box section 14 is located intermediate the end of the terminal 10 between the first slotted plate contact section 12 and the pin receptacle section 16 which comprises a disconnectable contact section. This electrical terminal 10 is used to establish an insulation displacement electrical connection between two wires. In the preferred embodiment of this invention the electrical connection is made between a discrete wire 4 and one of the leads 6A of capacitor 6. The disconnectable electrical interconnection formed by a receptacle 16 thus establishes an electrical connection between the wire 4, the one capacitor lead 6A and a mating terminal, such as a pin insertable into the pin receptacle 16. When such a pin is inserted into the receptacle section 16 contact is made by spring arms 18.

Terminal 10 comprises a stamped formed member and the first contact section 12 comprises two plates 20 and 22 which are generally parallel after insertion into the insulative housing. Each of these plates 20 and 22 contains a first slot 21 and 23 respectively for establishing an electrical connection to a wire inserted laterally of its axis into terminal 20. The first slotted plate contact section 12 is configured such that the slots 21 and 23 face outwardly in a first direction. A resilient arm 24 establishes an engagement between the two plates 20 and 22 at their inner end. These plates are also joined by bight section at their outer end.

Box section 14 located intermediate the ends of terminal 10 comprises a second slotted plate contact or insulation displacing contact section. This box section 14 includes two second slotted plates 30 and 32, also parallel to each other. Second slotted plate 30 has a slot 31 aligned with an additional slot 33 in the other second slotted plate 32. Slots 31 and 32 face in the opposite direction from slots 21 and 23. Slotted plates 30 and 32 extend transversely relative to slotted plates 20 and 22. The slots 31 and 33 are also laterally offset from either slot 21 in slotted plate 20 or slot 23 in slotted plate 22. In the preferred embodiment of this invention slots 31 and 33 are located between the plates 20 and 22 in which slots 21 and 23 are formed. Slotted plates 30 and 32 comprise opposite sides or walls of box section 14. The other two sides or walls of box section 14 are formed by front wall 34 and back wall 36. Front wall 34 is formed by the two end portions of the intermediate section of the stamped and formed terminal blank and the free ends of this portion of the terminal abut to form the two piece front wall 34. The back wall 36 is generally coplanar with the first plate 20 in the first slotted plate contact section. The insulation displacement contacts formed in box section 14 are located intermediate the ends of the terminal between the first slotted place contact section and the disconnectable receptacle contact section 16. A dog leg or offset section 38 is located between the box contact section 14 and the receptacle 16. Receptacle 16 is thus laterally offset from both the slots 31 in the box section 14 and one or both of the slots 21 and 23 in slotted plates 20 and 22.

Figure 4:
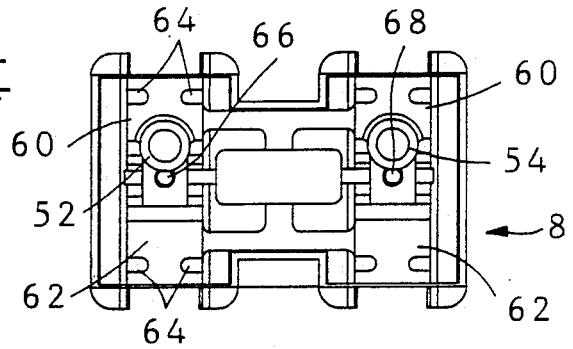
FIG. 4 is a top view of the insulative housing showing a pocket for receiving a capacitor.
Figure 2:
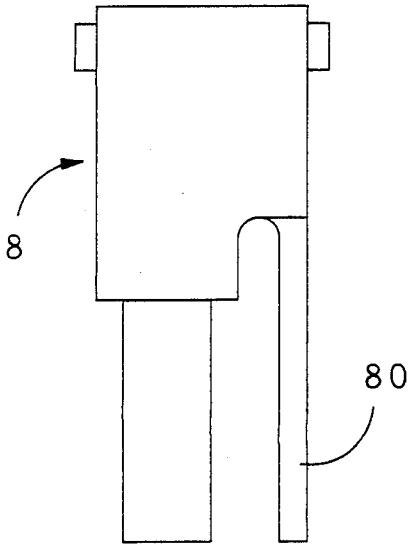
FIG. 2 is a side view of the insulative housing.
Figure 3:
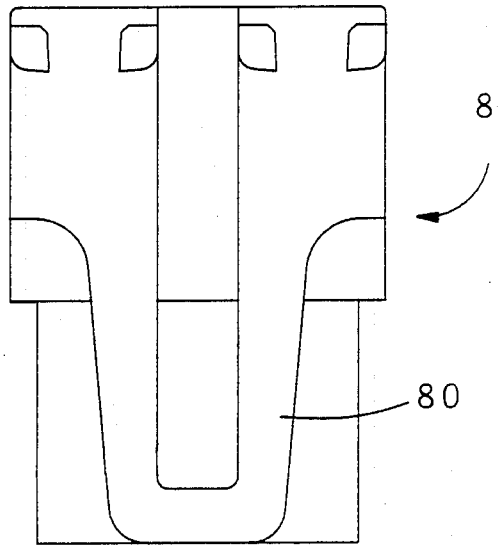
FIG. 3 is a front view of the insulative housing.
Figure 5:
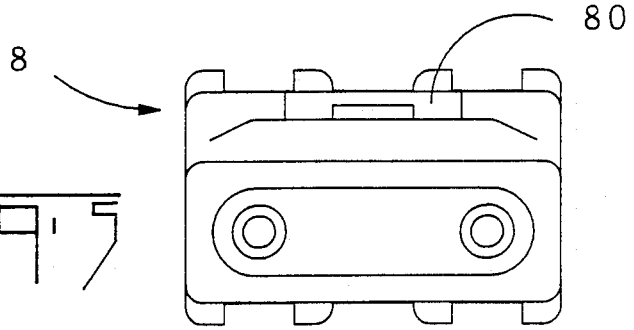
FIG. 5 is a bottom view of the insulative housing showing the mating face of the housing.

The insulative housing 8 has a first cavity 50 at one end. Two parallel passages 52 and 54 communicate with cavity 50 and extend between cavity 50 and the opposite or mating end of the housing 8. A pocket 58 located between passages 52 and 54 also communicates with cavity 50. This pocket 58 is dimensioned for receipt of a separate electrical component such as capacitor 6. First wire positioning means 60 and 62 in the form of shelfs comprising the lower surface of cavity 50 are located on opposite sides of each passage 52 and 54. Wire gripping protrusions extend upwardly from the wire positioning shelfs 60 and 62 so that a wire positioned along the wire positioning shelfs 60 and 62 will be gripped by these protrusions 64. The wire positioning or supporting shelfs 60 and 62 comprise means for positioning the wire move laterally of its axis into the first contact. Second wire positioning means or pedestals 66 and 68 are positioned adjacent to and laterally offset from each passage 52 and 54 as best seen in FIG. 4. These second wire positioning pedestals 66 and 68, comprise means for supporting wires or leads 6A extending from the separate component or capacitor 6.

This connector also includes a cover 70 which can be attached to the first end or side of the housing 8 to enclose cavity 50. Cover 70 has latches 72 engagable with protrusions on the exterior of the housing 8. In the preferred embodiment of this invention the cavity 50 can be filled with a suitable silicon sealant 76 of conventional fabrication so as to form a seal around the termination of wires 4, component lead 6A and the component 6 positioned within the cavity 50 and within the pocket 58. A thin sealant membrane 78, extends along one wall of the cavity 50. The thickness of this sealant membrane 78 is such that a wire 4 inserted laterally of its axis will locally rupture the sealant membrane 78. However, the sealant 76 will be retained within the cavity 50 by the membrane 78.

Electrical interconnection between wires 4 and capacitor 6 can be established by first positioning the capacitor 6 within pocket 58 with lead 6A extending over pedestal 66 and 68. Terminals 10 can then be inserted into the housing with the pin receptacle sections 16 inserted into passages 52 and 54. Full insertion of terminal 10 into the housing will bring the slots 31 and 33 in slotted plates 30 and 32 into engagement with the leads 6A. Wires 4 can then be positioned in alignment with slots 21 and 23 and the wire can be moved laterally of its axis onto the wire supporting surfaces 60 and 62 at the bottom of the cavity 50. Wires 4 will then be gripped by protrusions 64 and the wires 4 will rupture portions of the sealant membrane 78. Cap or cover 70 will be secured to the housing 8 to enclose cavity 50. The sealant 76 can be deposited within the cavity either before the capacitor 6 is positioned in the housing, between the time the capacitor 6 is positioned in the housing and in the terminals 10 are inserted therein, or the sealant can be added after termination of wires 4 and the capacitor 6. Although the preferred embodiment of this invention is suitable for use as a sealed connector and also as a filtered connector, it should be understood, that this connector is also suitable for use either in the unfiltered and/or the unsealed configuration. Therefore, the following claims would not be limited to the preferred embodiment of the invention depicted herein.

What is claimed:

1. An electrical terminal for establishing an insulation displacement electrical connection to two wires and for establishing a disconnectable electrical interconnection between both wires and a mating terminal, the electrical terminal comprising:

a stamped and formed member including;

a first slotted plate contact in which the slot faces in a first direction;

a second slotted plate contact and a second additional slotted plate contact in which slots in the second and second additional slotted plate contacts face in a second direction opposite from the first direction, the second slotted plate contact and the second additional slotted plate contact being intermediate the ends of the terminal in a box section with the second slotted plate contact and the second additional slotted plate contact being located in mutually parallel planes each extending transversely relative to a plane containing the first slotted plate contact;

a disconnectable contact section on the end of the terminal opposite from the first slotted plate contact, the second slotted plate contact being between the first slotted plate contact and the disconnectable contact section.

2. The electrical terminal of claim 1 wherein the second slotted plate contact is laterally offset from a plane containing the first slotted plate contact in a first lateral direction and the disconnectable contact section is offset in an opposite second lateral direction.

3. The electrical terminal of claim 1 wherein a first additional slotted plate contact is located substantially parallel to the first sloted plate contact.

4. The electrical terminal of claim 1 wherein the disconnectable contact section comprises a stamped and formed pin receptacle.

5. An electrical connector comprising:

two terminals each having first and second insulation displacement contact means facing in first and second opposite directions and a disconnectable contact section laterally offset from the two insulation displacement contact means;

an insulative housing having passages, the terminals extending into the passages with the first insulation displacement contact means on a first side of the housing and with the disconnectable contact section on an opposite second side of the housing, the passages communicating with a cavity on the first side, the housing also having a pocket communicating with the cavity, the pocket comprising means for receiving a leaded component prior to insertion of the terminals into the passages;

first wire supporting means for supporting a wire adjacent the first side of the housing and second wire supporting means adjacent each passage, the first wire supporting means comprising means for positioning a wire moved laterally of its axis in the first direction into the first insulation displacement contact means, the second wire supporting means comprising means for positioning a wire for engagement by the second insulation displacement contact means upon movement of portions of the terminals between the disconnectable contact section and the second insulation displacement contact means into the passages in the first direction.

6. The connector of claim 5 wherein the second wire supporting means comprises wire support pedestals on opposite ends of the pocket.

7. The connector of claim 5 further comprising a cover attachable to the insulative housing over the first cavity.

8. The connector of claim 7 further comprising a mass of sealant in the first cavity surrounding the first insulation displacement contact means and the leaded component.

9. An electrical terminal for establishing an insulation displacement electrical connection to two wires and for establishing a disconnectable electrical interconnection between both wires and a mating terminal, the electrical terminal comprising:

a one piece stamped and formed member including;

a first slotted plate contact comprising a pair of first parallel slotted plates each having a slot which faces in a first direction;

a second slotted plate contact comprising a pair of second parallel slotted plates each having a slot which faces in a second direction opposite from the first direction, the second pair of slotted plates lying in planes which are transverse to planes occupied by the first pair of slotted plates, the second slotted plate contact being intermediate the ends of the terminals;

a disconnectable contact section on the end of the terminal opposite from the first slotted plate contact, the second slotted plate contact being between the first slotted plate contact and the disconnectable contact section, the disconnectable contact section comprising a formed cylindrical section offset from both the first and second slotted plate contacts.

* * * * *